US008011434B2

(12) United States Patent
Cosgrove et al.

(10) Patent No.: US 8,011,434 B2
(45) Date of Patent: Sep. 6, 2011

(54) SUBSEA SECURING DEVICES

(75) Inventors: Patrick J Cosgrove, High Wycombe (GB); Douglas F Kirkman, Ickenham (GB); Terence Burgon, Henley upon Thames (GB)

(73) Assignee: M.S.C.M. Limited, Buckinghamshire (GB)

( * ) Notice: Subject to any disclaimer, the term of this patent is extended or adjusted under 35 U.S.C. 154(b) by 704 days.

(21) Appl. No.: 12/071,385

(22) Filed: Feb. 20, 2008

(65) Prior Publication Data

US 2008/0202760 A1 Aug. 28, 2008

(30) Foreign Application Priority Data

Feb. 24, 2007 (GB) ..... 0703617.1

(51) Int. Cl.
*E21B 23/00* (2006.01)

(52) U.S. Cl. ..... 166/341; 166/339; 166/344; 166/381

(58) Field of Classification Search ..... 166/338, 166/344, 368, 363, 364, 373, 339, 341, 381; 137/236.1, 260, 825, 635, 554, 557
See application file for complete search history.

(56) References Cited

U.S. PATENT DOCUMENTS

| | | | | | |
|---|---|---|---|---|---|
| 3,417,960 | A | * | 12/1968 | Stehlin | 251/14 |
| 3,605,414 | A | * | 9/1971 | Westmoreland, Jr. | 405/224 |
| 3,732,923 | A | * | 5/1973 | Fowler | 166/340 |
| 3,820,600 | A | * | 6/1974 | Baugh | 166/338 |
| 3,921,500 | A | * | 11/1975 | Silcox | 91/4 R |
| 3,987,638 | A | * | 10/1976 | Burkhardt et al. | 405/203 |
| 4,295,390 | A | * | 10/1981 | Buchta | 74/625 |
| 4,411,454 | A | * | 10/1983 | Nayler et al. | 285/26 |
| 4,431,059 | A | * | 2/1984 | Blenkarn et al. | 166/359 |
| 4,460,156 | A | * | 7/1984 | Hazelrigg et al. | 251/149.3 |
| 4,637,470 | A | * | 1/1987 | Weathers et al. | 166/344 |
| 4,899,822 | A | * | 2/1990 | Daeschler et al. | 166/339 |
| 5,265,980 | A | * | 11/1993 | Lugo et al. | 405/169 |
| 5,333,691 | A | * | 8/1994 | Dean et al. | 166/341 |
| 5,398,761 | A | * | 3/1995 | Reynolds et al. | 166/344 |

(Continued)

FOREIGN PATENT DOCUMENTS

GB 1 575 524 9/1980

(Continued)

OTHER PUBLICATIONS

Great Britain Search Report for Application No. GB 0703617.1.

(Continued)

*Primary Examiner* — Thomas A Beach
*Assistant Examiner* — Matthew R Buck
(74) *Attorney, Agent, or Firm* — Nixon & Vanderhye PC

(57) ABSTRACT

A securing device comprises an axially reciprocable drive shaft which has a head adapted to pass forwards through a detent plate. The head is adapted to engage the plate after rotation. A cam slot is defined in a drive housing and is engageable by a cam follower carried on the drive shaft. The cam slot has two end portions extending parallel to the axis of the drive shaft and an oblique intermediate part such that the drive shaft is rotated when the follower moves along the intermediate part and the drive shaft moves only axially when the follower moves along either of the end portions. A subsea assembly including the securing device includes a fixed stab plate including a central collar, and a free stab plate having an aperture through which said collar extends, the collar including an chamber defined by the detent plate.

18 Claims, 2 Drawing Sheets

U.S. PATENT DOCUMENTS

| | | | | |
|---|---|---|---|---|
| 5,529,126 | A * | 6/1996 | Edwards | 166/331 |
| 5,738,142 | A * | 4/1998 | Eike et al. | 137/596.17 |
| 5,794,701 | A | 8/1998 | Cunningham et al. | |
| 6,142,233 | A * | 11/2000 | Wilkins | 166/339 |
| 6,161,618 | A * | 12/2000 | Parks et al. | 166/351 |
| 6,226,068 | B1 * | 5/2001 | Arcykiewicz et al. | 439/314 |
| 6,484,806 | B2 * | 11/2002 | Childers et al. | 166/351 |
| 6,644,410 | B1 * | 11/2003 | Lindsey-Curran et al. | 166/360 |
| 7,216,715 | B2 * | 5/2007 | Reynolds | 166/339 |
| 7,243,729 | B2 * | 7/2007 | Tyrrell et al. | 166/338 |
| 2009/0038805 | A1 * | 2/2009 | Parks et al. | 166/341 |
| 2009/0211762 | A1 * | 8/2009 | Voss | 166/351 |

FOREIGN PATENT DOCUMENTS

| | | |
|---|---|---|
| GB | 2 330 603 | 4/1999 |
| GB | 2 377 239 | 1/2003 |
| GB | 2 390 654 B | 11/2004 |

OTHER PUBLICATIONS

Pejaver et al., "Diverless Maintained Cluster (DMaC) Subsea Production System," *Offshore Technology Conference*, (2001), pp. 209-220.

* cited by examiner

SUBSEA SECURING DEVICES

FIELD OF THE INVENTION

The invention relates to securing devices, particularly for coupling a free plate and fixed plate, particularly in a subsea context and more particularly to the coupling of a free subsea stab plate to a fixed stab plate.

BACKGROUND TO THE INVENTION

Subsea stab plates contain an array of equipment, typically self-sealing hydraulic couplings and/or electrical connections. There is typically a fixed stab plate which is attached to a sub-sea structure to which hydraulic or electrical lines are run to an array of fixed half-couplings on this stab plate. The free stab plate has a corresponding array of the free halves of the electrical and hydraulic couplings to which hydraulic tubes or electric cables connected to surface equipment are attached. A so-called umbilical connection, often many kilometers long, takes the supply lines from the surface equipment to the free stab plate.

Initially the free stab plate would be at the surface awaiting deployment. The free stab plate would then be transported, preferably by means of a remote operated subsea vehicle (ROV), to the subsea structure.

The invention relates to the means whereby two members, and particularly a 'free' plate and a 'fixed' plate, are oriented to accept each other, captured, brought together and clamped. An important requirement of the device is that it shall be possible to unclamp and remove the free plate.

It is known to provide on the fixed plate a central thread engageable with a rotatable nut loosely clamped to the centre of the free plate. Such a nut has to be accessible even though it be surrounded by stab couplings and hose lines, and for this purpose it is customary to arrange the hose lines to extend sideways from the free plate and to extend the nut to be clear of the hoses and/or supply lines.

A securing device, which comprises a drive shaft longitudinally reciprocable forwards and backwards along its axis and having at one end a head adapted to pass forwards through a key aperture in a wall member when the drive shaft is in at least a first angular position, the head being adapted to engage the wall member when the drive shaft is in a second angular position and is moved rearwards, is known from the document OTC 6720, Proceedings of the 23rd Offshore Technology Conference, Houston, Tex., May 1991 pages 209-220.

The present invention relates to a improved device which has a more general utility but in the subsea context facilitates clamping and also facilitates removal of the free plate even in the event of seizure of parts or fouling of the device by marine growth, so that for example the free plate may be removed and taken back to the surface for repair while the fixed plate remains on the subsea structure in an immediately reusable condition.

SUMMARY OF THE INVENTION

A securing device in a preferred form of the invention comprises a drive shaft which is longitudinally reciprocable forwards and backwards along its axis and having at one end a head adapted to pass forwards through a key aperture in a wall member when the drive shaft is in at least a first angular position, the head being adapted to engage the wall member when the drive shaft is in a second angular position and is moved rearwards. At least one cam slot is defined in a drive housing and is engageable by a cam follower carried on the drive shaft. The cam slot has two portions extending parallel to the axis of the drive shaft and an intermediate part extending obliquely between the said portions such that the drive shaft is rotated between the said angular positions when the follower moves along the intermediate part and the drive shaft moves only axially when the follower moves along either of the said portions.

The cam follower may comprise a radially directed peg. Preferably the drive housing is a generally cylindrical housing through which the drive shaft extends. The cam follower may be supported by a sleeve surrounding the housing and moveable conjointly with the drive shaft. The sleeve may carry a member for visibly indicating the position of the drive shaft.

The cam follower may comprise a radially directed peg, and may be located relative to the drive shaft by a shear pin.

Preferably the drive member carries a plurality of cam follower members each engaging a respective cam slot. In particular there may be two cam follower members, disposed diametrically opposite each other around the drive shaft.

The device may include end stops for limiting axial movement of the drive shaft before the cam follower reaches an end of the cam slot.

Preferably the housing is secured to a bucket guide which is locatable by a subsea ROV and within which an operating member for the drive shaft is located. The drive shaft preferably threadingly engages a drive nut which acts as the operating member and is restrained against axial movement.

The device is preferably adapted for securing a free plate to a fixed plate, the said wall member being part of a collar fixed to the fixed plate and extending through the free plate and the drive housing being secured to the free plate.

The invention extends to a subsea assembly comprising a securing device as defined above, a fixed stab plate including a central collar, and a free stab plate having an aperture through which said collar extends, the collar including an chamber defined by an end wall that includes said key aperture.

Preferably the plates carry a multiplicity of electrical and/or hydraulic couplings which are mated as the securing device pulls the plates together by rearward movement of the head against the wall member.

One example of the invention is hereinafter described in detail with reference to the accompanying drawings.

DETAILED DESCRIPTION

Figure 1:
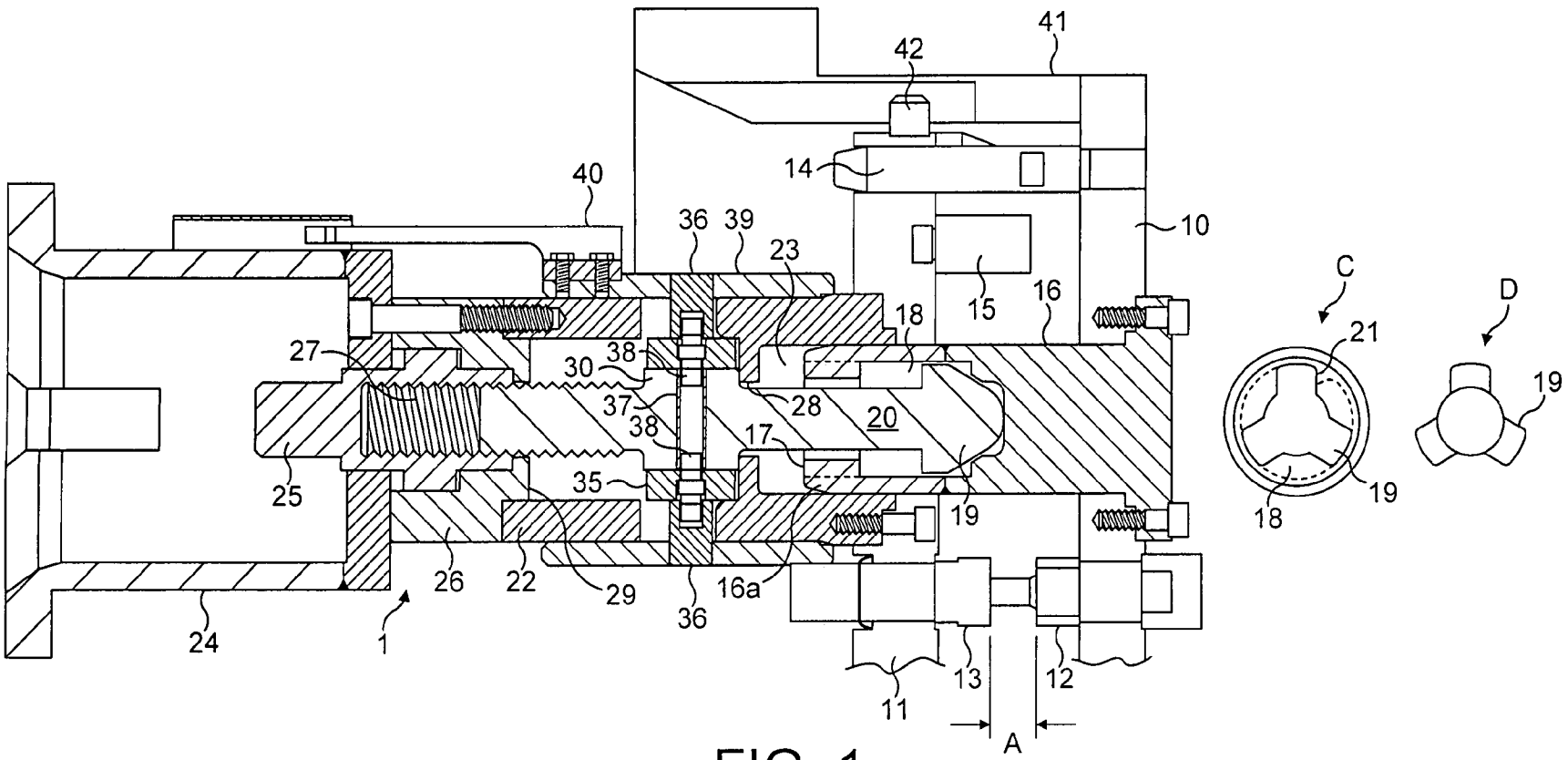
FIG. 1 is a sectional view of one exemplary embodiment of the invention in one state of operation.
Figure 2:
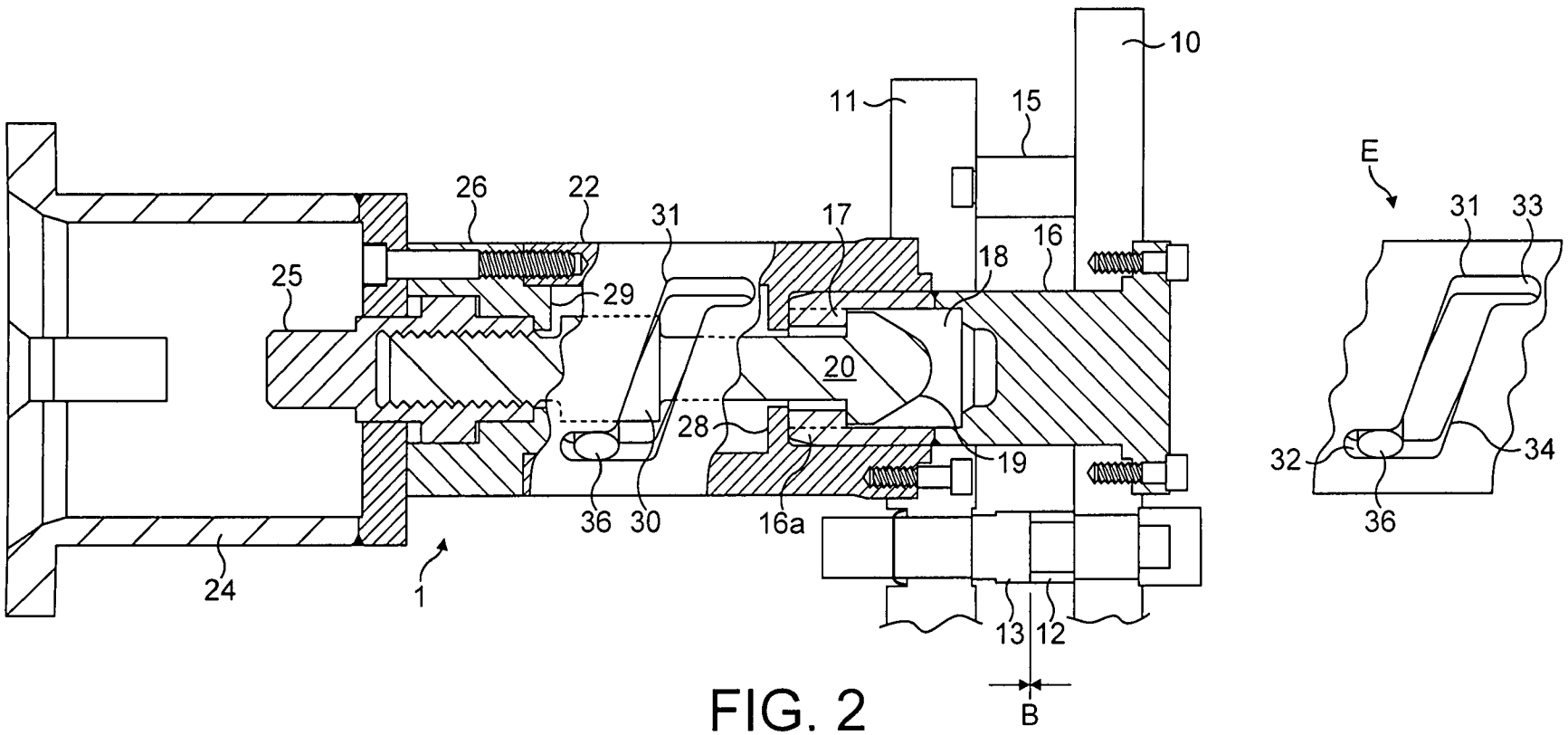
FIG. 2 is a sectional view of the same embodiment, shown in another state of operation.

FIG. 1 of the drawings shows in side view, partly sectioned a device 1 according to the invention in conjunction with a fixed, subsea stab plate 10 and a free subsea stab plate 11 after the plates have been brought into close proximity but are not yet closed together. FIG. 2 is another side view (at right angles to the first) and shows the same plates 10 and 11 after they have been closed together. The fixed and free plates each carry a plurality of respective halves of mateable couplers, either hydraulic or electric or both. One such half-coupler is exemplified by a coupler 12 on the fixed plate; it can be mated with a complementary coupler 13 carried on the free plate. For ease of illustration other couplers have been omitted. The fixed plate 10 carries a plurality of alignment pins such as the alignment pin 14 which extends in a direction normal to the fixed plate and can engage a corresponding aperture in the free plate 11.

One of the plates 10 and 11, in this example the free plate 11, carries stand-off pins 15 which set the maximum amount of make-up which can occur; that is to say, they set the minimum distance separating the plates 10 and 11. Lines A show the separation of the couplers in FIG. 1 and line B the minimum (zero) separation of the couplers in FIG. 2.

Fixed to the plate 10 and extending normally to it is a central locking collar 16, which extends into a central aperture in the free plate. This collar 16 has an end wall 16*a* which contains a lobed keying aperture 17 which allows the passage, into a chamber 18, of a triple-lobed spigot head 19 of a drive shaft 20. The collar 16 contains an internal integral stop 21 which can be engaged by a lobe of the spigot head 19 to limit the permissible rotation of the lobed spigot head 19 while the spigot head is within in the collar 16. The cavity 18 including the lobed spigot head 19 and the stop 21 is shown in end view by the detail C and the spigot head 19 is shown in end view by the detail D. As will be explained in more detail later, the head 19 can be, if correctly presented, pass though the key aperture 17, rotated and then pulled back against the collar wall 16*a* in which the key aperture 17 is formed. Typically the clearance between the lugs or lobes of the spigot head 19 and the key aperture 17 would be about 0.3 mm and the required turn of the spigot head 19 would be about 60°.

Attached to the free plate 11 is a generally cylindrical drive housing 22 which contains most of the working parts of the device. The drive housing has at its end secured to the free plate a open cylindrical chamber 23 into which fits the end of the collar 16. The drive housing 22 is axially aligned with and secured to an operating guide 24. In this example the guide is in the ordinary form of an 'ROV bucket'. This has a conventional shape which allows an ROV to locate and engage an external operating member 25 for the device 1. The shape of the bucket is determined by the need to have in practice a common agreed shape for location and engagement by ROVs.

The operating member 25 for the device 1 is in this example an engageable rotary member constituted by a square-headed nut which is held by the bucket 24 within a collar 26 constituting the respective end of the drive housing. The nut has an annular flange disposed between an internal shoulder of the collar 26 and the base of the bucket 24, so that the nut 25 can rotate, but is restrained against axial movement.

Extending within the nut is a threaded part 27 engaged with the threaded drive shaft 20, which will move axially relative to the housing as the nut 25 is rotated.

In this example the drive housing 22 provides two end stops which, as will be explained, limit the axial movement of the drive shaft 20. These end stops are constituted by inwardly directed annular flanges, particularly the flange 28 at the inner end of the chamber which receives the collar 16 and the flange 29 at the inner end of the collar 26 which houses the nut 25 These end stops can be abutted by a hub 30 at the middle part of the drive shaft.

Reference should now be made particularly to FIG. 2 and the detail E, which both show the shape of a cam slot 31 in the drive housing. This slot, hereinafter called a Z-slot, has two terminal portions 32 and 33 extending parallel to the axis of the drive shaft 20 and an intermediate part 34 which extends obliquely between the terminal parts 32 and 33.

This drive housing 22 contains two such Z-slots 31 diametrically opposite each other, disposed in the region of the hub 30 on the drive shaft. The hub 30 carries a collar 35 from which extend radially two cam followers, constituted by drive pegs 36, each engaging a respective one of the Z-slots 31. When the drive nut 25 is rotated (in this example anti-clockwise) the drive shaft 20 moves forward and when the pegs 36 enter the oblique parts 34 of the Z-slots 31, the drive shaft is turned as the pegs progress along the parts 34. At the end of the forward stroke each peg 36 enters the terminal, axially extending portion 33 of the respective slot 31 and the shaft moves forwards until the hub 30 abuts the end stop 28. Contrary rotation, in this example clockwise rotation, of the nut 25 returns the drive shaft 20 into the nut 25, the pegs 36 in the Z-slots 31 turning the drive shaft 20 and the spigot head 19 relative to the drive housing. At the end of the return stroke the hub 30 on the drive shaft approaches the end stop 29. It will not normally in use abut this end stop but may do so in a 'bench test' in the absence of the plates 10 and 11. It is very preferable to ensure that the hub engages one or other of the end stops 28 and 29 before the pegs 36 reach the end of a terminal portion of their Z-slots 31. Because of this arrangement the mating and unmating torques applied to the drive shaft do not apply significant shear forces to the shear pins described below.

A cross bore 37 through the hub 30 of the drive shaft 20 receives the shanks of two shear pins 38 which are attached to the collar 35 and extend through it to bores in the pegs 36. An external sleeve 39 can rotate on the drive housing and grips the outer part of each of the drive pegs 36. The sleeve 39 moves with the drive shaft and acts as a cover for the working mechanism. The sleeve 39 carries an indicator arm 40, which enables the position of the drive shaft to be viewed by camera and relayed to the operator of the ROV.

The fixed plate 10 is attached to a guide cage 41 which has grooves to accept guide pins 42 extending laterally of the free plate 11.

In use the fixed plate 10 is attached to the structure associated with the sub-sea oil well, the fixed couplers (self-sealing if they are hydraulic) are piped or wired to their functions. The fixed plate has its external guide cage forming a conical guidance towards the couplings.

The free plate 11 with its matching array of couplers and the umbilical of hydraulic tubes and electrical connections which couple it to the surface equipment is grasped by the ROV in an industry standard method using the guide bucket 24. The ROV can turn the drive nut 25 either clock or anti-clockwise at preset maximum or variable torque levels.

The ROV now takes the free plate 11, device 1 and the umbilical to the subsea structure. It may grasp the structure or continue to 'fly' and offers the assembly into the fixed plate guide cage. The cone and guide pin(s) of the cage 41 centralise the free plate 11 to the fixed plate 10 as it is inserted.

Further insertion allows the guide pins 14 to enter their apertures so as to align the couplers and plates. The drive shaft (still in its preset start orientation) will slide through the key aperture 17 in the drive housing. Further engagement of the free unit by the ROV causes the drive shaft end to strike the cavity end in the fixed drive housing. It cannot go further. The ROV starts clockwise rotation of the nut 25, causing the drive shaft to move first along the line of the legs 32 of the Z slots, then to turn through 60° as the pegs 36 follow the oblique parts 34 of the Z-slot 31. There is no further rotation of the drive shaft 20 when the pegs enter the terminal portions 33 and the pulling of the head against the wall 16*a* forces the fixed and free plates together. The ROV continues to tighten the plates 10 and 11 together by clockwise rotation of the nut 25 until the stand-off pins 15 touch the opposing plate and the torque requirement of the assembly has been reached. The plates are now fully made up.

A usual ROV can give 2000 Nm torque and it may be required to 'make up' the free plate with 1300 Nm torque. This may give a make-up load between the plates of 200 kN.

It may be noted that the make-up operation has subjected the shear pins to negligible shear loads.

The ROV, having installed the equipment, would leave the installation functioning and only in case of maintenance should the need to disassemble the stab plates arise.

The ROV would then 'fly' to the subsea structure and locate the ROV bucket 24 and drive nut 25, remain attached and by anti-clockwise rotation first remove the clamp load as the drive shaft 20 follows the in-line legs of the Z-slot, then rotates anti-clockwise through 60° as the pegs 36 follow the central parts 34 of the Z-slots 31. The spigot head 19 is now in its start position i.e. the three lobes are fully lined up with the key aperture 17 in the datum wall 16*a*. At this stage, after further anti-clockwise rotation which does not affect orientation, the free stab plate and umbilical etc. may be completely removed. Again of note is the fact that this complete operation has subjected the shear pins to negligible shear loads and that no action is required of the ROV to determine the alignment of the spigot head 19 and the key aperture 17.

If however due to some occurrence, seizure of nut and thread, marine growth etc, the ROV finds that the expected anti-clockwise torque on the drive nut will not release the free plate, then the torque may be increased until the shear pins 38 shear. In this situation (when the shaft and nut behave as one seized part) the shear pins are under immediate radial shear load. On shearing of the shear pins 38 the previously clamped combined shaft and the spigot head 19 turn until the spigot head engages the stop 21. The stop 21 defines the correct position for full withdrawal of the free plate and its attachments. The fixed plate is undamaged by these activities and can be reused without rework.

What is disclosed is a connection device with one part containing a stab plate with many male half self-sealing couplings being remotely (typically subsea on an oil well structure) installed. The other female part of the connection device containing a stab plate with the other female halves of the self-sealing couplings is to be 'flown in' by the ROV to be mated with the unit installed on the structure.

The female connection device automatically lines itself up, centralises itself, orients itself and engages alignment pins as it is moved into contact with fixed male unit.

Having one central screw mechanism enables this device to be simply made up by an ROV which requires only one torque tool. The couplings being made up often contain internal pressure and the array of couplings being made up produce a considerable separating force from this initial pressure. Finally when the system is performing its intended function the lines will be fully pressurized. The unit has to withstand this separation force without backing off over time and be able to mate and demate at this condition. A total separating force of 250,000 Newtons from lines pressurised to 1500 bar are current values.

To make up against these loads requires a high torque, typically: 1500 Newton-meters. Materials of manufacture are such that use of 25 years is expected.

What is claimed is:

1. A subsea securing device comprising:

a wall member including a key aperture;

a drive shaft longitudinally reciprocable axially forwards and backwards and having at one end a head adapted to pass forwards through said key aperture when the drive shaft is in at least a first angular position, the head being adapted to engage the wall member when the drive shaft is in a second angular position and is moved backwards;

a drive housing which defines at least one cam slot, said cam slot having two portions extending parallel to the axis of the drive shaft and an intermediate part extending obliquely between said portions; and a cam follower for engagement with said cam slot and carried by said drive shaft;

whereby said drive shaft is rotated between said angular positions when said cam follower moves along said intermediate part and said drive shaft moves only axially when said cam follower moves along either of said portions.

2. The securing device of claim 1 in which said cam follower comprises a radially directed peg.

3. The securing device of claim 1 in which said drive housing is a generally cylindrical housing through which said drive shaft extends.

4. The securing device of claim 3 and further comprising a sleeve which supports said cam follower, surrounds said housing and is moveable conjointly with said drive shaft.

5. The securing device of claim 4 in which said sleeve carries a member for visibly indicating the position of said drive shaft.

6. The securing device of claim 1 in which said drive shaft includes a shear pin on which said cam follower is located.

7. The securing device of claim 1 in which said drive member carries a plurality of cam followers each engaging a respective cam slot.

8. The securing device of claim 7 in which there are two cam followers, disposed diametrically opposite each other.

9. The securing device of claim 1 and including at least one end stop for limiting axial movement of said drive shaft before said cam follower reaches an end of said cam slot.

10. The securing device of claim 1 in which said head is multiply lobed.

11. The securing device of claim 1 and further comprising a drive nut, and means for restraining axial movement of said drive nut, said drive shaft threadingly engaging said drive nut.

12. The securing device of claim 1 and further comprising a bucket guide which is locatable by a subsea ROV, and an operating member for the drive shaft located within said bucket guide.

13. The securing device of claim 12 in which said operating member comprises an axially restrained drive nut.

14. A subsea assembly comprising:

a securing device comprising:

a wall member including a key aperture;

a drive shaft longitudinally reciprocable forwards and backwards along its axis and having at one end a head adapted to pass forwards through said key aperture when the drive shaft is in at least a first angular position, the head being adapted to engage the wall member when the drive shaft is in a second angular position and is moved backwards;

a drive housing which defines at least one cam slot, said cam slot having two portions extending parallel to the axis of the drive shaft and an intermediate part extending obliquely between said portions; and a cam follower for engagement with said cam slot and carried by said drive shaft;

a fixed stab plate including a central collar; and a free stab plate having an aperture through which said collar extends, said collar including an chamber for receiving said head, said chamber being defined by said wall member that includes said key aperture.

15. The subsea assembly of claim 14 in which said fixed and free stab plates carry a multiplicity of mateable couplings.

16. The subsea assembly of claim 14 and further comprising a sleeve which supports said cam follower, surrounds said housing and is moveable conjointly with said drive shaft.

17. The subsea assembly of claim 16 in which said sleeve carries a member for visibly indicating the position of said drive shaft.

18. The subsea assembly of claim 14 in which said drive shaft includes a shear pin on which said cam follower is located.

* * * * *